US008235026B2

(12) United States Patent
Yamaguchi et al.

(10) Patent No.: US 8,235,026 B2
(45) Date of Patent: Aug. 7, 2012

(54) FUEL INJECTION CONTROL APPARATUS FOR ENGINE

(75) Inventors: Yohei Yamaguchi, Kobe (JP); Yasuhiko Ishida, Kobe (JP)

(73) Assignee: Mitsubishi Electric Corporation, Tokyo (JP)

( * ) Notice: Subject to any disclaimer, the term of this patent is extended or adjusted under 35 U.S.C. 154(b) by 379 days.

(21) Appl. No.: 12/691,498

(22) Filed: Jan. 21, 2010

(65) Prior Publication Data

US 2011/0073077 A1 Mar. 31, 2011

(30) Foreign Application Priority Data

Sep. 25, 2009 (JP) ..... 2009-221089

(51) Int. Cl.
*F02M 51/00* (2006.01)
*F02D 41/06* (2006.01)

(52) U.S. Cl. ..... 123/491; 123/179.16

(58) Field of Classification Search ..... 123/478, 123/488, 491, 179.16; 701/103, 104, 113
See application file for complete search history.

(56) References Cited

U.S. PATENT DOCUMENTS

| | | | | |
|---|---|---|---|---|
| 5,419,291 | A * | 5/1995 | Kimata et al. | 123/179.16 |
| 6,349,702 | B1 * | 2/2002 | Nishiyama | 123/456 |
| 6,557,530 | B1 * | 5/2003 | Benson et al. | 123/480 |
| 6,575,143 | B2 * | 6/2003 | Uemura et al. | 123/490 |
| 6,854,450 | B2 * | 2/2005 | Kitagawa et al. | 123/491 |
| 6,907,857 | B2 * | 6/2005 | Saito et al. | 123/299 |
| 7,287,515 | B2 * | 10/2007 | Okamura et al. | 123/494 |
| 7,318,415 | B2 * | 1/2008 | Fukasawa | 123/458 |
| 7,318,421 | B2 * | 1/2008 | Fukasawa | 123/491 |
| 7,509,944 | B2 * | 3/2009 | Okamura | 123/478 |
| 7,634,985 | B2 * | 12/2009 | Parker et al. | 123/435 |
| 7,832,375 | B2 * | 11/2010 | Dusa et al. | 123/446 |
| 7,891,339 | B2 * | 2/2011 | Takahashi et al. | 123/447 |
| 7,905,217 | B2 * | 3/2011 | Namari et al. | 123/491 |

FOREIGN PATENT DOCUMENTS

| | | | |
|---|---|---|---|
| JP | 62-69040 | U | 4/1987 |
| JP | 63-147940 | A | 6/1988 |
| JP | 07-208236 | A | 8/1995 |
| JP | 08-189390 | A | 7/1996 |
| JP | 08-303293 | A | 11/1996 |
| JP | 2001-336436 | A | 12/2001 |
| JP | 2003-003889 | A | 1/2003 |
| JP | 2004-211613 | A | 7/2004 |
| JP | 2005-330815 | A | 12/2005 |
| JP | 2009-144618 | A | 7/2009 |

* cited by examiner

*Primary Examiner* — Thomas Moulis
(74) *Attorney, Agent, or Firm* — Sughrue Mion, PLLC

(57) ABSTRACT

To improve a restart failure during fuel vapor occurrence, in a fuel injection control apparatus for an engine that is not equipped with a battery and starts the engine by a manual operation, the fuel injection control apparatus for an engine includes: an injector that supplies fuel to the engine based on pressure of the fuel supplied by a fuel pump; a power generating section for generating power based on rotation driving of a crank shaft of the engine; a starting device for manually starting the engine; and a control section for starting with power generation voltage by the power generating section and calculating a fuel injection amount based on an operation state of the engine. The control section includes: an injection amount calculating function unit that calculates, according to the operation state of the engine, an injection amount of the fuel to be supplied to the engine; an injection time conversion coefficient calculating function unit that calculates an injection time conversion coefficient for converting the injection amount into injector driving time based on a predicted fuel pressure value; and an injector driving time calculating function unit that calculates driving time of the injector based on an output of the injection amount calculating function unit and an output of the injection time conversion coefficient calculating function unit.

6 Claims, 13 Drawing Sheets

(INJECTOR INJECTION TIME = INJECTION AMOUNT × INJECTION TIME CONVERSION COEFFICIENT + INJECTOR WASTE TIME)

FUEL INJECTION CONTROL APPARATUS FOR ENGINE

BACKGROUND OF THE INVENTION

1. Field of the Invention

The present invention relates to a fuel injection control apparatus for an engine, and more particularly, to a fuel injection control apparatus for a small outboard engine that is started by manual rotation of a crank shaft.

2. Description of the Related Art

In a small outboard engine with small displacement, fuel supply by a carburetor system is mainly used. A battery or the like is not equipped therein. For the start of the small outboard engine, a recoil starting device is equipped rather than a starter or the like and an operator manually starts the small outboard engine. In this manner, in general, the small outboard engine is light in weight and low in cost.

In recent years, fuel supply for the small outboard engine with small displacement is changed from one based on the carburetor system to an electronic control system for the purpose of improvement of operability, maintainability, exhaust gas purification, and output performance. However, in order that an engine be configured to be small in size, light in weight, and low in cost, a starting device such as a starter, a battery, and the like are often not mounted therein. There is an apparatus including an injector and a fuel pump that perform fuel supply to an engine, a fuel pressure regulator that keeps fuel pressure constant, a sensor that detects operation state of the engine, and an electronic control unit (ECU) as control means for performing fuel control. The apparatus is equipped with a generator that performs power supply to those devices. The apparatus actuates the ECU and the injector based on a power supply of the generator upon driving of the engine and is not mounted with a battery (see, for example, Japanese Patent No. 3858582 B).

There is also an apparatus that improves startability by switching the use of an electric fuel pump that supplies fuel using an output of a generator according to manual start and a mechanically-driven fuel pump that receives mechanical driving force and supplies fuel according to manual start (see, for example, Japanese Patent Application Laid-Open No. 2005-330815).

When the engine is started, in particular, in the fuel control apparatus not equipped with a battery, the injector, the electric fuel pump, and the ECU cannot be started and the fuel supply cannot be performed unless the generator that performs generation with driving force from the crank shaft of the engine sufficiently generates power. Therefore, during manual start operation, first, power is generated by cranking. Then, the device such as the ECU is started. After the ECU is started, the ECU calculates a fuel supply amount based on a state of the engine, fuel supply to the engine is started by injector driving, engine torque is generated by combustion through an ignition after that, and the operation of the engine itself is started.

Before calculating injector driving time in the ECU in order to supply the fuel to the engine during the engine start and driving the injector for the calculated period of time, it is necessary to drive the electric fuel pump, raise the pressure of the fuel supplied to the injector, and keep the pressure at a predetermined value. Even if the injector is driven for the same period of time, a fuel amount supplied to the engine is different if the fuel pressure is different. Therefore, in some case, when a fuel amount necessary for starting the engine is smaller than a requested value, the combustion through the ignition is unstable. Unlike the start by the starter or the like, in manual cranking, the cranking can be continued only for several rotations of the engine. Therefore, in some case, the engine itself cannot be started.

Therefore, it is necessary to start power generation as early as possible during the manual cranking, start a fuel device, and raise the fuel pressure as quickly as possible by the driving of the electric fuel pump. However, for the fuel pressure to reach a predetermined value, a delay of predetermined period of time occurs in proportion to a piping capacity of the injector and the fuel pump. When the injector is driven during the delay, an injection amount is insufficient because the fuel pressure is insufficient. Therefore, it is necessary to prohibit the driving of the injector until the fuel pressure reaches the predetermined value. This causes a delay in the start of the engine.

Time required for raising the fuel pressure depends upon initial fuel pressure in pipes of the injector and the electric fuel pump before the start of the engine. In the case where rest time after the engine stop is long, the initial fuel pressure when the engine is started is lower in comparison with the case where the engine start and stop are repeatedly performed. Therefore, longer period of time is required until the fuel pressure reaches a predetermined pressure. In order to secure stable startability, it is necessary to set injector driving prohibition time according to this long period of time.

When the engine operation is continuously performed with high load and, after the operation, the engine is stopped and rested for several minutes, engine atmosphere temperature rises because of engine temperature. Therefore, in some case, the fuel temperature in the injector pipe rises and vapor (vaporization of the fuel) occurs. When the engine is started in a state in which the vapor occurs, in some case, the vapor is discharged from the injector even if the injector is driven, and hence a target amount of the fuel cannot be supplied to the engine and the engine cannot be started because of fuel insufficiency. In such a state, the manual start operation has to be repeated until the vapor is discharged from the injector or the engine has to be rested for a period of time enough for the engine to be sufficiently cooled and the vapor to be naturally eliminated.

SUMMARY OF THE INVENTION

The present invention has been devised in view of the related art and it is an object of the present invention to provide a fuel injection control apparatus for an engine that is not equipped with a battery and starts the engine by a manual operation. The fuel injection control apparatus can solve a start failure due to insufficiency of an injection amount during fuel pressure rise at the beginning of the starting and a restart failure during fuel vapor occurrence immediately after high-load operation.

A fuel injection control apparatus for an engine according to the present invention includes: operation state detecting means for detecting an operation state of the engine; a fuel pump having a fuel pressure adjusting function; an injector that supplies fuel to the engine based on pressure of the fuel supplied by the fuel pump; power generating means for generating power based on rotation driving of a crank shaft of the engine; a starting device for manually starting the engine; and control means for starting with power generation voltage by the power generating means and calculating a fuel injection amount based on a detection value from the operation state detecting means, in which the control means includes: an injection amount calculating function unit that calculates, according to the operation state of the engine, an injection amount of the fuel to be supplied to the engine; an injection time conversion coefficient calculating function unit that calculates an injection time conversion coefficient for converting the injection amount into injector driving time based on a predicted fuel pressure value; and an injector driving time calculating function unit that calculates driving time of the injector based on an output of the injection amount calculating function unit and an output of the injection time conversion coefficient calculating function unit.

According to the present invention, in the fuel injection control apparatus for an engine that is not equipped with a battery and starts the engine by a manual operation, it is possible to solve a start failure due to insufficiency of an injection amount during fuel pressure rise at the beginning of the starting and a restart failure during fuel vapor occurrence immediately after high-load operation.

DETAILED DESCRIPTION OF THE INVENTION

Figure 1:
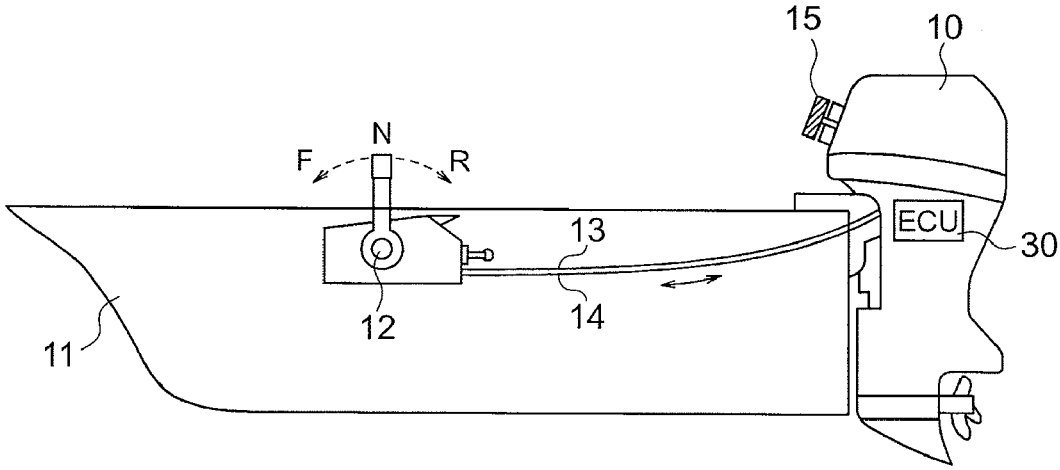
FIG. 1 is a schematic diagram of an overall fuel injection control apparatus for a marine internal combustion engine according to an embodiment of the present invention.

Before the specific description of an embodiment of the present invention, control content in a fuel injection control apparatus for an engine according to the present invention is generally described. After start of an ECU by a generation power supply by manual start operation, delay time equivalent to several rotations of the engine occurs from the start of driving of an electric fuel pump by the ECU until a fuel pressure value of fuel to be supplied to the injector rises to a predetermined value. During the delay time, when the driving of the injector is stopped, the start is correspondingly delayed. In the present invention, the fuel pressure of the fuel to be supplied to the injector is predicted and calculated by the ECU at every predetermined period of time. An injection time conversion coefficient for converting an injection amount into injector driving time is calculated based on the predicted fuel pressure value. The injector driving time is calculated based on the injection time conversion coefficient from the injection amount calculated from an operation state of the engine, and hence it is possible to accurately supply a fuel injection amount even during the rise of the fuel pressure to the predetermined value such as during the start of the engine. Therefore, it is possible to stabilize combustion and improve startability of the engine.

The injection time conversion coefficient is uniquely calculated according to the fuel pressure. However, initial fuel pressure during ECU start by start operation is different depending upon engine rest time from the last driving and a temperature state. Therefore, the initial fuel pressure is measured and adapted in advance at engine temperature and intake air temperature during the ECU start according to a driving pattern assumed in the market. The initial fuel pressure is set as map data in the ECU. An initial value of the fuel pressure is calculated by interpolation from the map data based on the engine temperature and the intake air temperature during the ECU start. An injection time conversion coefficient adapted and set in advance is calculated from the map data based on a fuel pressure value and injector driving time is calculated. Actual fuel pressure rises to an adjusted pressure value in predetermined period of time and keeps a predetermined value. Therefore, the calculated fuel pressure is raised to the adjusted pressure value at every predetermined period of time and set and adapted so as to be approximate to the actual fuel pressure. This makes it possible to accurately supply the fuel amount without depending upon an engine state before the start and improve startability of the engine.

In a state in which the fuel to be supplied to the injector is vaporized and vapor occurs according to temperature rise of the engine atmosphere, even if the injector is driven, the vaporized fuel is supplied to the engine by the injector. Therefore, in some case, a fuel amount necessary for combustion is insufficient, combustion is unstable, and requested engine output is not obtained. When the vapor occurs, in particular, in a region where an injection amount is small such as starting and idling region, long period of time is required until the vapor disappears. Therefore, it is anticipated that the starting is impossible or an engine stall occurs during the idling. In the present invention, during the ECU start, a restart state immediately after high-load operation are determined from the engine temperature and the intake air temperature. A vapor occurrence state of the fuel between the injector and the fuel pump is predicted and the injection time conversion coefficient is corrected to increase injector driving time. This makes it possible to compensate for insufficiency of an engine requested fuel amount due to the vapor so as to stabilize combustion, perform satisfactory starting, and maintain idling.

An exemplary embodiment of the present invention are described below with reference to the drawings. FIG. 1 is a schematic diagram of an overall fuel injection control apparatus for a marine combustion engine according to an embodiment of the present invention. An outboard engine 10 as a propelling engine (hereinafter referred to as "outboard engine"), in which an internal combustion engine (hereinafter referred to as "engine"), a shaft, a propeller, and the like are integrated, includes an electronic control unit (ECU) 30 as control means and is mounted at a stern of a boat (small boat) 11. A throttle lever 12 is arranged in an operation seat. The throttle lever 12 adjusts an opening amount (intake air amount) of a throttle valve through a link mechanism (not shown) in the outboard engine 10 via a throttle cable 13. The throttle lever 12 sets a shift position (forward, neutral, and backward) through the link mechanism and a gear mechanism in the outboard engine 10 via a shift cable 14. A recoil type starting device 15 that starts the engine by a manual operation is mounted on the outboard engine 10. The engine not equipped with a battery and a starter can be started by manually pulling the recoil type starting device 15 to rotate a crankshaft.

Figure 2:
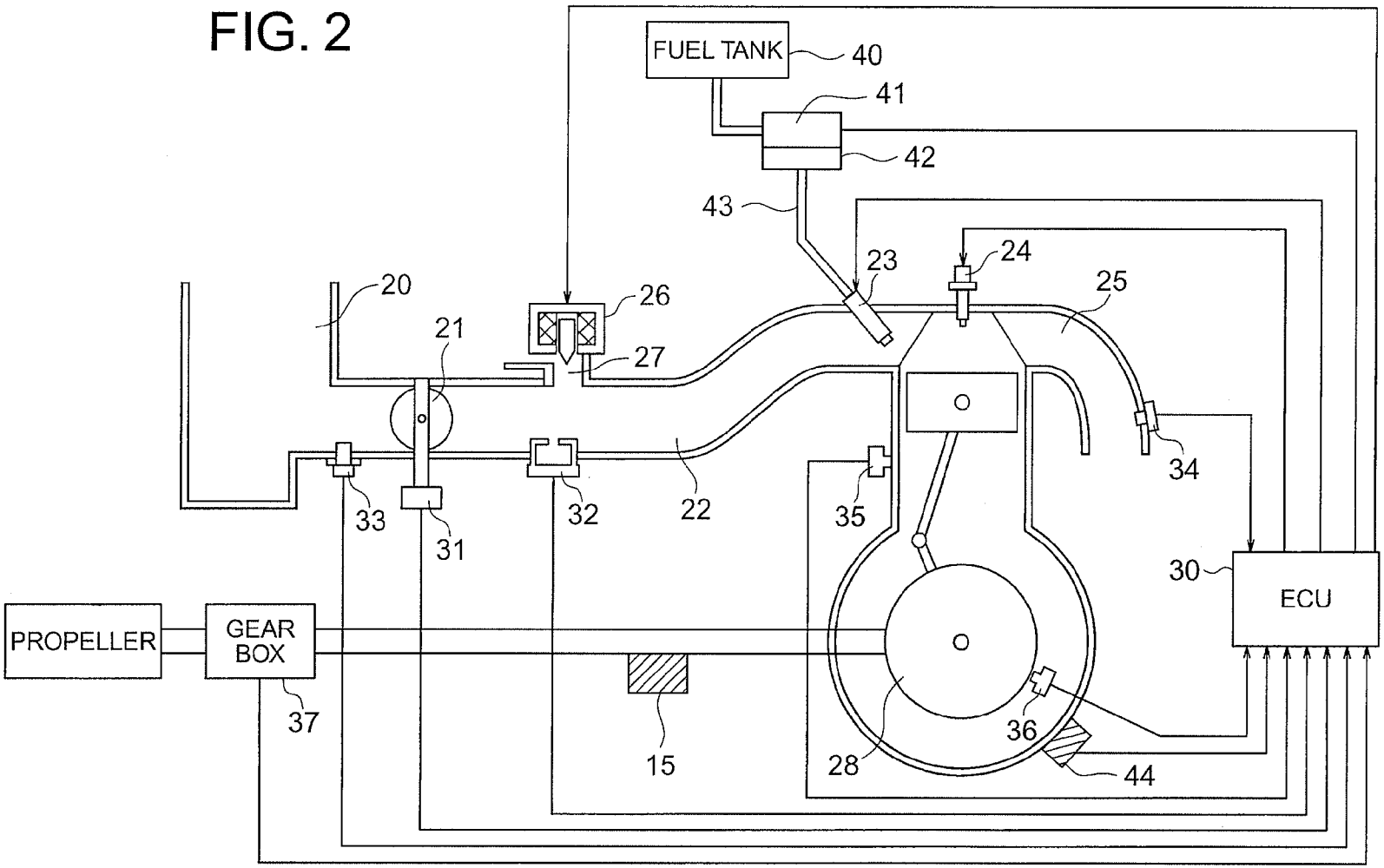
FIG. 2 is a detailed schematic diagram of an engine in an outboard engine 10 illustrated in FIG. 1.

FIG. 2 is a detailed schematic diagram of the engine in the outboard engine 10 illustrated in FIG. 1. The air is taken into the engine illustrated in FIG. 2 via an intake pipe 20. The intake air flows through an intake manifold 22 while a flow rate thereof is adjusted via a throttle valve 21. An injector 23 is arranged immediately before a combustion chamber of the intake manifold 22 and injects gas fuel. The intake air is mixed with the injected gas fuel to form mixed air, flows into each of cylinder combustion chambers, and is ignited by a spark plug 24 and burned. Exhaust gas after combustion flows through an exhaust manifold 25 and is discharged to the outside of the engine.

A throttle opening sensor 31 as idling state detecting means for detecting an idling state of the engine is connected to the throttle valve 21. The throttle opening sensor 31 outputs a signal proportional to throttle opening according to the rotation of a throttle valve shaft. The throttle opening sensor 31 determines, according to a throttle opening signal, whether the throttle valve 21 is fully closed and detects that the engine is in an idling state. An absolute pressure sensor 32 is arranged downstream of the throttle valve 21 and outputs a signal corresponding to intake pipe absolute pressure $P_B$ (engine load). An intake air temperature sensor 33 is arranged upstream of the throttle valve 21 and outputs a signal proportional to intake air temperature AT.

An overheat sensor 34 is arranged in the exhaust manifold 25 and outputs a signal proportional to engine exhaust temperature. A wall temperature sensor 35 as engine temperature detecting means for detecting warming-up of the engine is arranged in an appropriate position of a cylinder block near the overheat sensor 34 and outputs a signal proportional to engine cooling wall temperature WT.

An idle speed control (ISC) valve 26 controls, during idling, an air amount for keeping an idling state. When an increase in the air amount is necessary, the ISC valve 26 is moved to be narrowed according to a number-of-steps reducing command to increase a space 27 and increase an amount of the intake air. When the air amount is reduced, the ISC valve 26 is moved to be widened according to a number-of-steps increasing command to fill the space 27 with the valve, reduce an amount of the intake air, and realize maintenance of the idling state.

A shift position sensor as load detecting means for detecting whether a shift position state of the engine is neutral, forward, or backward is arranged in a gear box 37 near a shift link mechanism. The shift position sensor outputs a signal corresponding to a shift position operated (neutral/forward/backward). In this manner, an engine load is detected.

Signals of the various sensors are sent to the ECU 30 via a signal line. A crank angle sensor 36 functioning as engine-number-of-revolutions detecting means for detecting the number of revolutions of the engine is arranged near a flywheel 28 mounted via the crankshaft. The crank angle sensor 36 outputs a crank angle signal and sends the crank angle signal to the ECU 30. The ECU 30 calculates an engine rotation speed NE from the output of the crank angle sensor 36.

In FIGS. 1 and 2, when an operator manually pulls the recoil type starting device 15, the crankshaft rotates and the crank rotates. A generator 44 driven by the crankshaft generates power according to the rotation of the crank and supplies the generated power to the ECU 30, the injector 23, the electric fuel pump 41, and the like. The started electric fuel pump 41 supplies the fuel, which is supplied from a fuel tank 40, to the injector 23 by a fuel amount calculated by the ECU 30. However, the fuel pressure of a fuel pressure adjusting mechanism 42 immediately after startup has not fully risen, and hence the fuel pressure is lower than predetermined fuel pressure. Compared with a fuel amount supplied when the fuel pressure is adjusted, the fuel pressure is low, and hence a fuel amount is lower than a fuel amount desired to be supplied. Therefore, the engine includes means for predicting fuel pressure immediately after the start from wall temperature and intake temperature during the start so as to adjust the injection time conversion coefficient and setting fuel injection time to be long so as to correct an insufficient fuel amount due to the low fuel pressure to a proper amount.

When the atmosphere temperature of the engine rises, if a phenomenon occurs in which the temperature of the fuel pipe 43 rises and the fuel is boiled and vaporized (vapor), because of the vaporized fuel, a fuel amount is smaller than the fuel amount desired to be supplied. Therefore, means is prepared, for determining, from states of the wall temperature and the intake air temperature immediately after the start, whether vapor occurs in the fuel pipe 43, performing adjustment of the injection time conversion coefficient as vapor correction during the determination, and setting fuel injection time to be long so as to correct an insufficient fuel amount due to the low fuel pressure to a proper amount.

Figure 3:
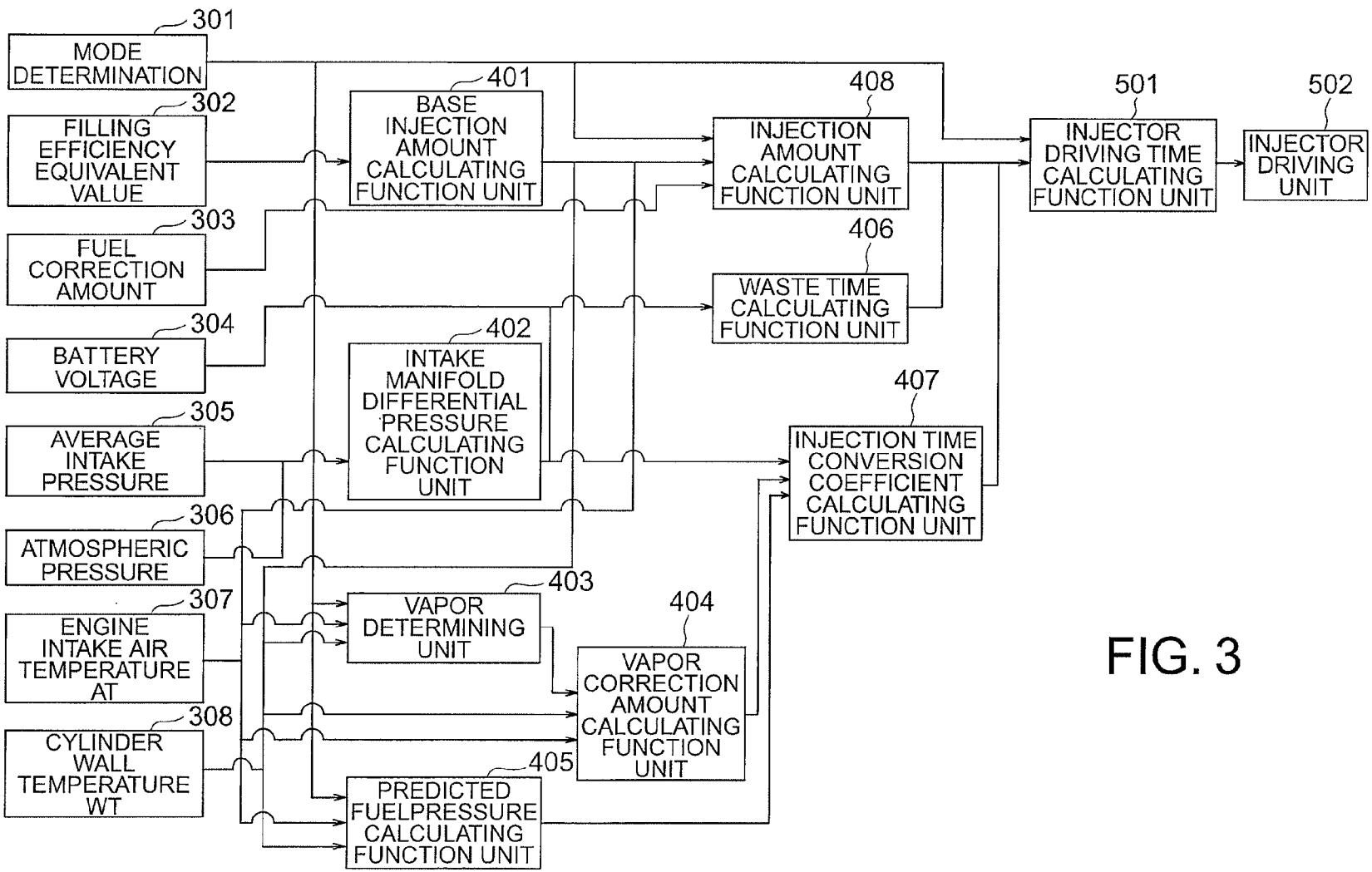
FIG. 3 is an operation function block diagram of an ECU 30 illustrated in FIG. 1 and is a diagram for describing the operation of the fuel injection control apparatus for a marine combustion engine illustrated in FIG. 1.

The operation of the fuel injection control apparatus for a marine internal combustion engine illustrated in FIGS. 1 and 2 is described with reference to an operation function block diagram of the ECU 30 as control means illustrated in FIG. 3. In FIG. 3, the ECU 30 inputs the following: mode determination 301 indicating whether the present engine state (operation state) is an engine stall or a start mode and whether a normal mode is a fuel cut mode; a filling efficiency equivalent value 302 obtained by multiplying a value calculated from a map of rotating speed and intake air pressure with a correction value at the atmospheric pressure, multiplying the multiplied value with air density and dividing the value by standard atmosphere density, and multiplying the multiplied and divided value with a filter value; a fuel correction amount 303 obtained by multiplying an A/F correction value calculated from the rotating speed, the filling efficiency equivalent value, a target air-fuel ratio (hereinafter referred to as A/F), and a theoretical air-fuel ratio with a correction value during deceleration and multiplying the multiplied value with a correction value during fuel cut; battery voltage 304 supplied to the ECU, the injector, and the electric fuel pump by power generation; average intake air pressure 305 calculated for each stroke; an atmospheric pressure value 306 obtained by regarding intake air pressure in an engine stall state as the atmospheric pressure; an intake air temperature value 307; and a cylinder wall temperature value 308. The ECU 30 carries out various calculation functions.

Specifically, the ECU 30 includes the following: a base injection amount calculating function unit 401 that calculates a base injection amount based on the filling efficiency equivalent value 302; an intake manifold differential pressure calculating function unit 402 that calculates intake manifold differential pressure from the average intake air pressure 305 and the atmospheric pressure value 306; a vapor determining unit 403 that determines presence or absence of vapor from the mode determination 301, the engine intake air temperature 307, and the cylinder wall temperature 308; a vapor correction amount calculating function unit 404 that calculates a vapor correction amount from an output of the vapor determining unit 403, the engine intake air temperature 307, and the cylinder wall temperature 308; and a predicted fuel pressure calculating function unit 405 that calculates predicted fuel pressure from the mode determination 305, the engine intake air temperature 307, and the cylinder wall temperature 308.

Further, the ECU 30 includes the following: a waste time calculating function unit 406 that calculates waste time from the battery voltage 304 and an output of the intake manifold differential pressure calculating function unit 402; an injection time conversion coefficient calculating function unit 407 that calculates an injection time conversion coefficient from the output of the intake manifold differential pressure calculating function unit 402, an output of the vapor correction amount calculating function unit 404, and an output of the predicted fuel pressure calculating function unit 405; an injection amount calculating function unit 408 that calculates an injection amount from the mode determination 301, an output of the base injection amount calculating function unit 401, and the fuel correction amount 303; an injector driving time calculating function unit 501 that calculates injector driving time from the mode determination 301, an output of the injection amount calculating function unit 408, an output of the waste time calculating function unit 406, and an output of the injection time conversion coefficient calculating function unit 407; and an injector driving unit 502 that drives the injector 23 based on an output of the injector driving time calculating function unit 501.

Base Injection Amount Calculating Function

Figure 4:
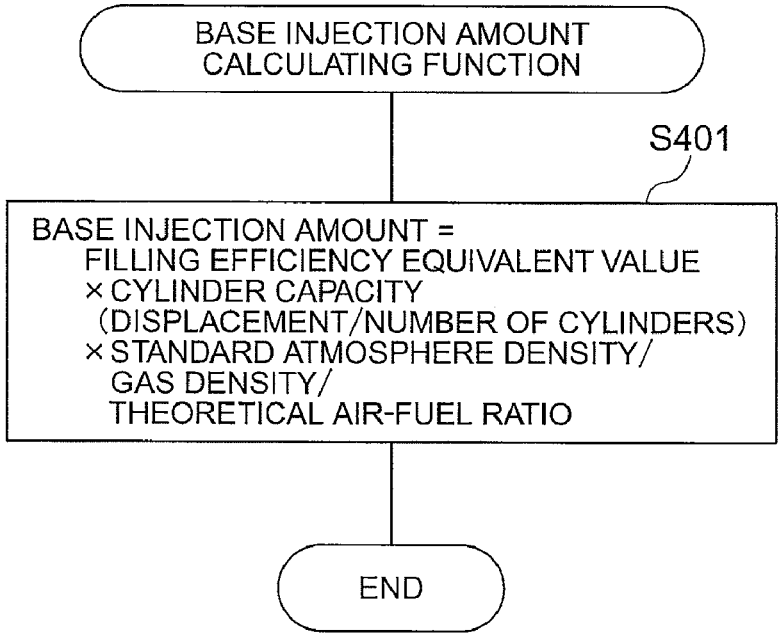
FIG. 4 is a flowchart for describing a base injection amount calculating function by a base injection amount calculating function unit 401 illustrated in FIG. 3, and for setting a basic fuel amount according to an engine.

FIG. 4 is a flowchart for describing a base injection amount calculating function by the base injection amount calculating function unit 401 illustrated in FIG. 3, and for setting a basic fuel amount according to the engine. In FIG. 4, in S401, the base injection amount calculating function unit 401 sets a base injection amount according to a value obtained by multiplying a filling efficiency equivalent value calculated according to the engine in advance with a cylinder capacity (=displacement/the number of cylinders) and further multiplying the multiplied value with standard atmosphere density and dividing the multiplied value by gas density and a theoretical air-fuel ratio.

Intake Manifold Differential Pressure Calculating Function

Figure 5:
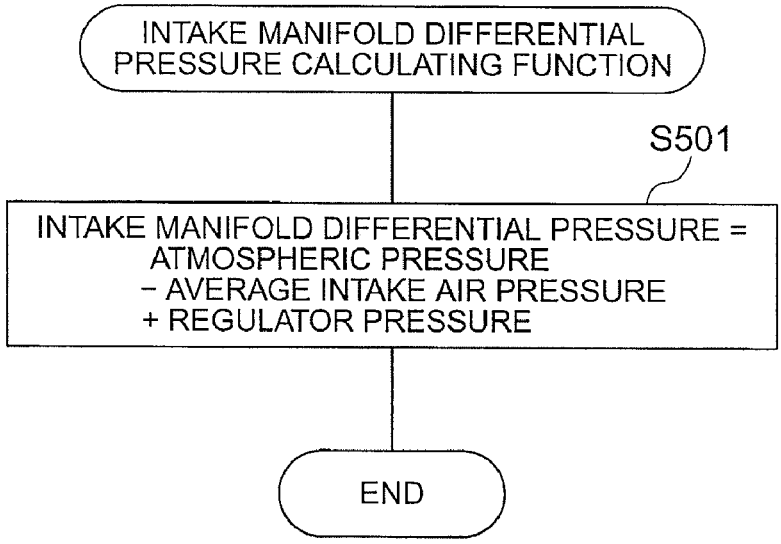
FIG. 5 is a flowchart for describing an intake manifold differential pressure calculating function by an intake manifold differential-pressure calculating function unit 402 illustrated in FIG. 3, and for calculating a pressure difference in an intake manifold.

FIG. 5 is a flowchart for describing an intake manifold differential pressure calculating function by the intake manifold differential pressure calculating function unit 402 illustrated in FIG. 3, and for calculating a pressure difference in the intake manifold. In FIG. 5, in S501, the intake manifold differential pressure calculating function unit 402 calculates the differential pressure in the intake manifold according to a value obtained by adding regulator pressure to a value obtained by subtracting an average intake air pressure value from an atmospheric pressure value.

Vapor Determination

Figure 6:
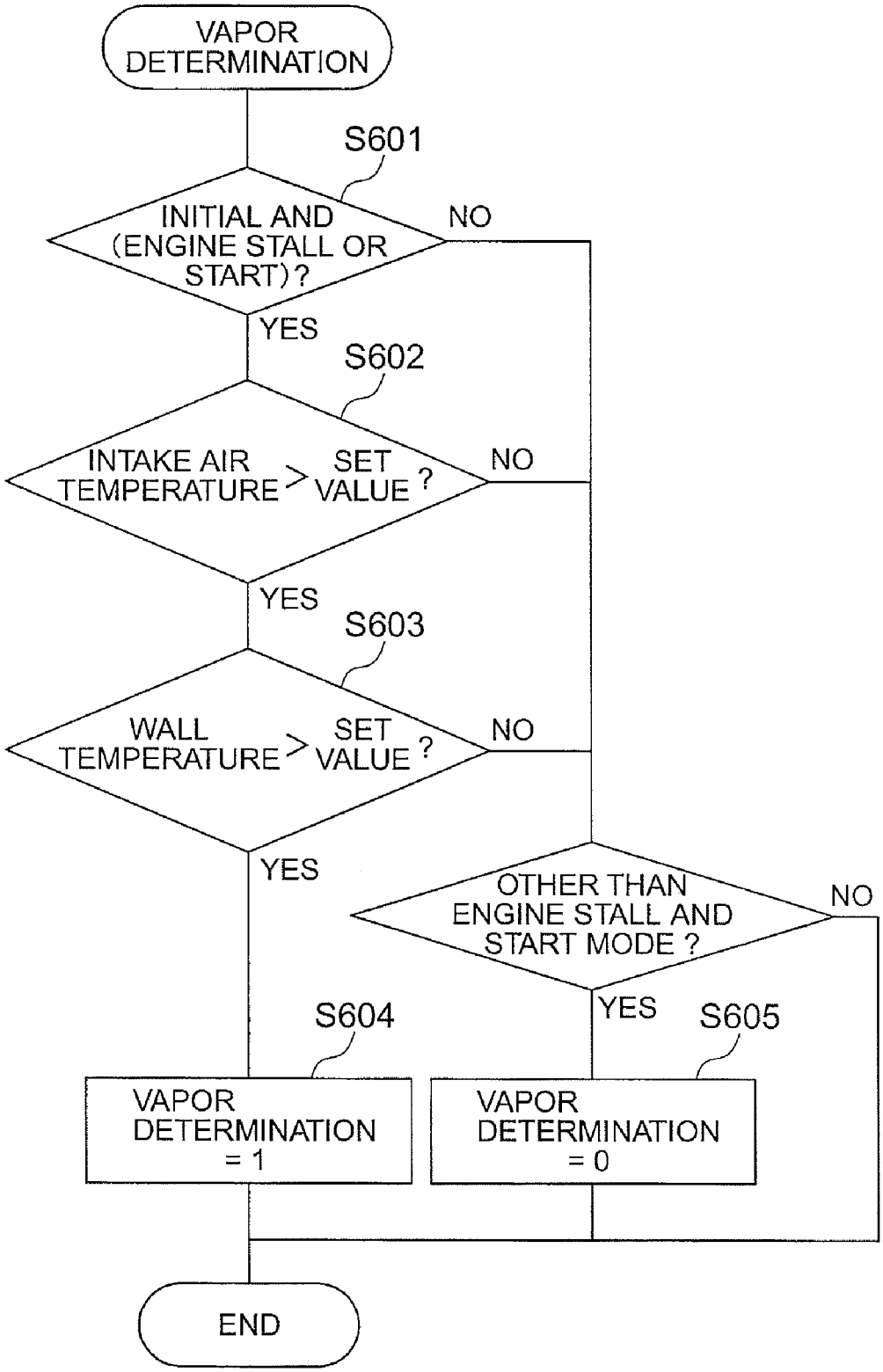
FIG. 6 is a flowchart for determining presence or absence of vapor with a vapor determining unit 403 illustrated in FIG. 3.

FIG. 6 is a flowchart for determining presence or absence of vapor with the vapor determining unit 403 illustrated in FIG. 3. When the engine is stopped after continuous operation of the engine, the vapor determining unit 403 determines whether the fuel is in a vaporized state. In an initial state in which the ECU 30 is stared up, the vapor determining unit 403 checks an engine stall and a start mode (S601). When the intake air temperature and the wall temperature are respectively larger than set values, the vapor determining unit 403 determines that vapor is present (vapor determination=1) and maintains a determination flag until the engine leaves the engine stall or the start mode (S602, S603, and S604). In engine states other than the engine stall and the start mode, the vapor determining unit 403 determines that vapor is not present (vapor determination=0) (S605).

Vapor Correction Amount Calculating Function

Figure 7:
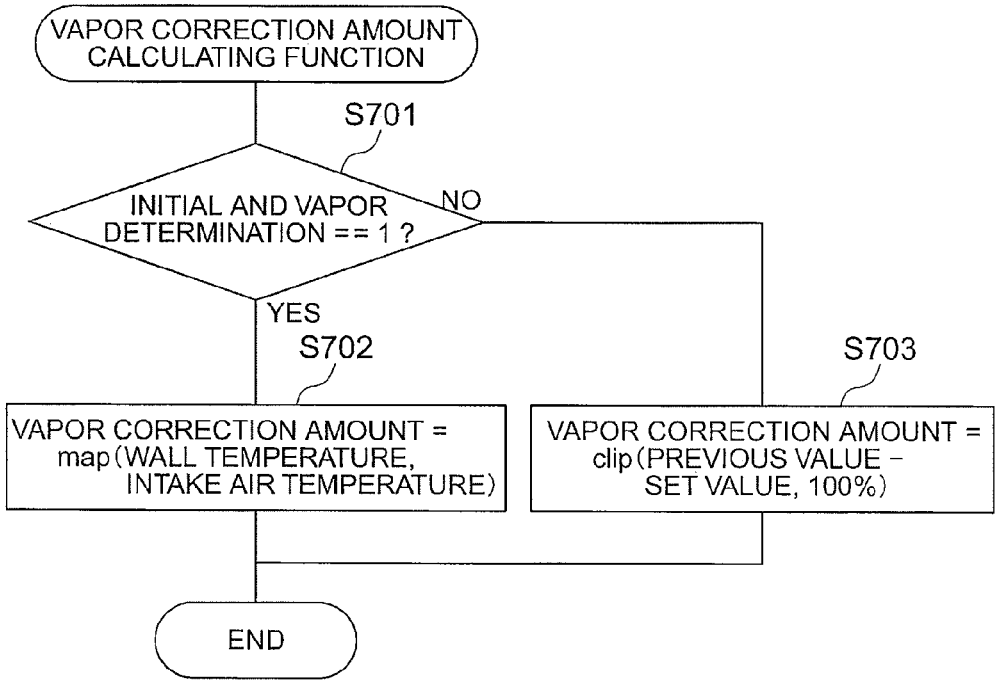
FIG. 7 is a flowchart for describing a vapor correction amount calculating function by a vapor correction amount calculating function unit 404 illustrated in FIG. 3.
Figure 8:
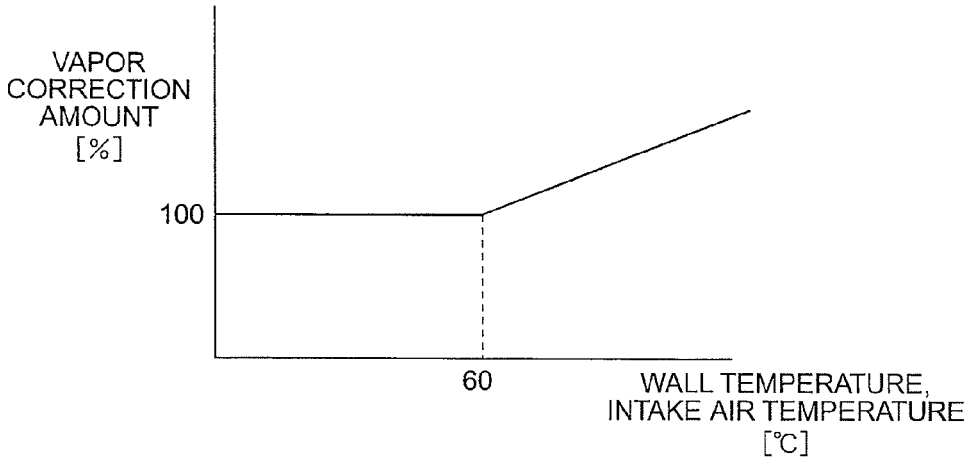
FIG. 8 is a graph of a characteristic of a vapor correction amount map stored in storing means in the ECU.

FIGS. 7 and 8 are diagrams for describing a vapor correction amount calculating function by the vapor correction amount calculating function unit 404 illustrated in FIG. 3. FIG. 7 is a flowchart for setting a vapor correction amount. FIG. 8 is a graph for describing a characteristic of a vapor correction amount map. For example, when the engine is stopped after continuous operation of the engine, if fuel injection is executed in a state in which the fuel is vaporized, a predetermined injection amount is reduced due to the vaporized gas. Therefore, in the vaporized state, the vapor correction amount calculating function unit 404 sets injection time to be longer than predetermined fuel injection time as a vapor correction amount so as to perform correction of a fuel amount reduced due to vaporization. In the initial state in which the ECU is started up, when the vapor determination by the vapor determining unit 403 is true, the vapor correction amount calculating function unit 404 sets, as an initial value, a vapor correction amount from the vapor correction amount map illustrated in FIG. 8 in which a correspondence relation between the wall temperature (engine temperature) and the intake air temperature and the vapor correction amount is matched in advance (S701 and S702). Thereafter, the vapor correction amount calculating function unit 404 gradually reduces the vapor correction amount from the initial value by predetermined data (set value) at every predetermined period of time after the start of the ECU or at every predetermined engine rotating number until the paper correction amount is reduced to 0 (S703). The vapor correction amount map having the characteristic as illustrated in FIG. 8 includes a three-dimensional map of the wall temperature and intake air temperature and the vapor correction amount and is stored in an area corresponding to the vapor correction amount calculating function unit for a ROM (not shown) in a microcomputer in the ECU. Note that, although the vapor correction amount map as illustrated in FIG. 8 includes the three-dimensional map of the wall temperature and intake air temperature and the vapor correction amount, the vapor correction amount may be calculated by using a two-dimensional map of the wall temperature or the intake air temperature and the vapor correction amount.

Predicted Fuel Pressure Calculating Function

Figure 9:
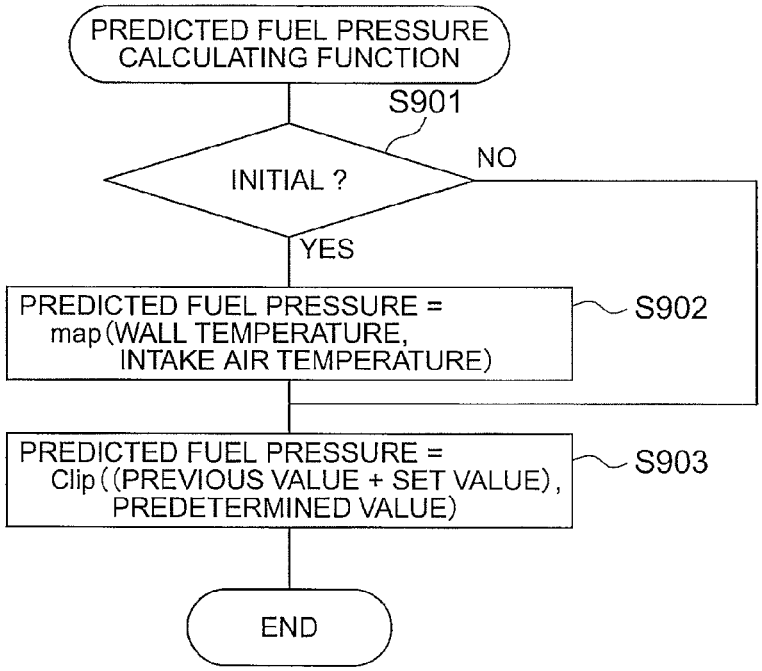
FIG. 9 is a flowchart for describing a predicted fuel pressure calculating function by a predicted fuel pressure calculating function unit 405 illustrated in FIG. 3.
Figure 10:
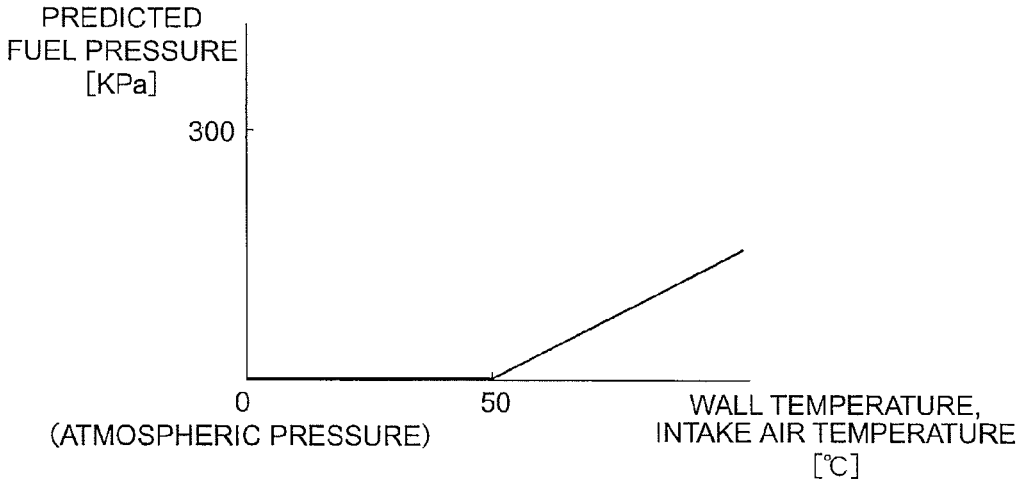
FIG. 10 is a graph for describing a characteristic of a predicted fuel pressure map stored in the storing means in the ECU.

FIGS. 9 and 10 are diagrams for describing a predicted fuel pressure calculating function by the predicted fuel pressure calculating function unit 405 illustrated in FIG. 3. FIG. 9 is a flowchart for setting predicted fuel pressure. FIG. 10 is a graph for describing a characteristic of a predicted fuel pressure map. The predicted fuel pressure calculating function unit 405 predicts that the fuel pressure is low during manual start because the power is not supplied from the battery and thereafter adds a set value to an initial value from the ECU start at every predetermined period of time until the initial value is increased to a predetermined value that reaches actual fuel pressure. In this way, the predicted fuel pressure calculating function unit 405 calculates the predicted fuel pressure that gradually increase from the ECU start. First, in S901, the predicted fuel pressure calculating function unit 405 carries out initial determination. When a determination result is true, in S902, the predicted fuel pressure calculating function unit 405 sets predicted fuel pressure of an initial value from a predicted fuel pressure map in which the correspondence relation between the wall temperature and the intake air temperature and the predicted fuel pressure is set. When the determination result is false, in S903, as an action in the second and subsequent times, the predicted fuel pressure calculating function unit 405 adds, without setting an initial value, the set value to the previous value, thereafter adds the set value at every predetermined period of time or until the previous value reaches the predetermined value in synchronization with engine rotating speed, and calculates predicted fuel pressure for estimating a rise in fuel pressure at fixed gradient from the initial value to the predetermined value. The predicted fuel pressure map having the characteristic as illustrated in FIG. 10 includes a three-dimensional map of the wall temperature and intake air temperature and the predicted fuel pressure and is stored in an area corresponding to the predicted fuel pressure calculating function unit of the ROM (not shown) in the microcomputer in the ECU. Note that, although the predicted fuel pressure map as illustrated in FIG. 10 includes the three-dimensional map of the wall temperature and intake air temperature and the predicted fuel pressure, the predicted fuel pressure may be calculated by using a two-dimensional map of the wall temperature or the intake air temperature and the predicted fuel pressure.

Waste Time Calculating Function

Figure 11:
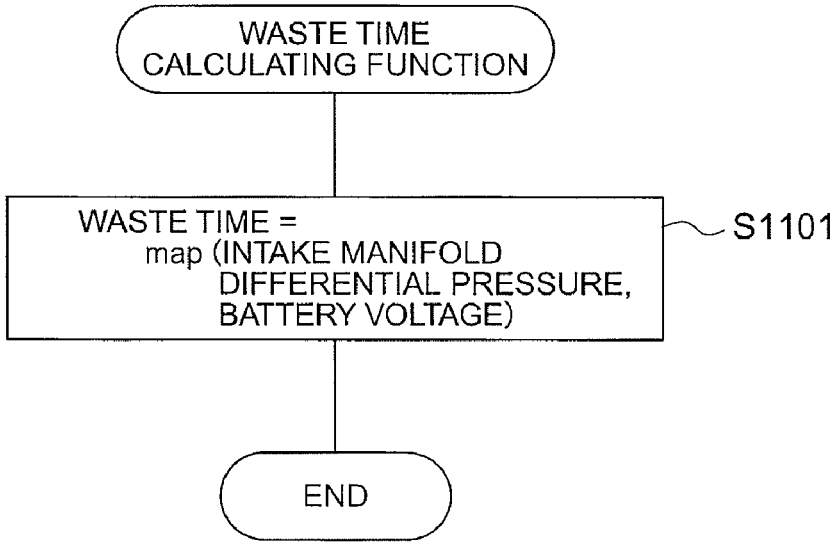
FIG. 11 is a flowchart for describing a waste time calculating function by a waste time calculating function unit 406 illustrated in FIG. 3.
Figure 12:
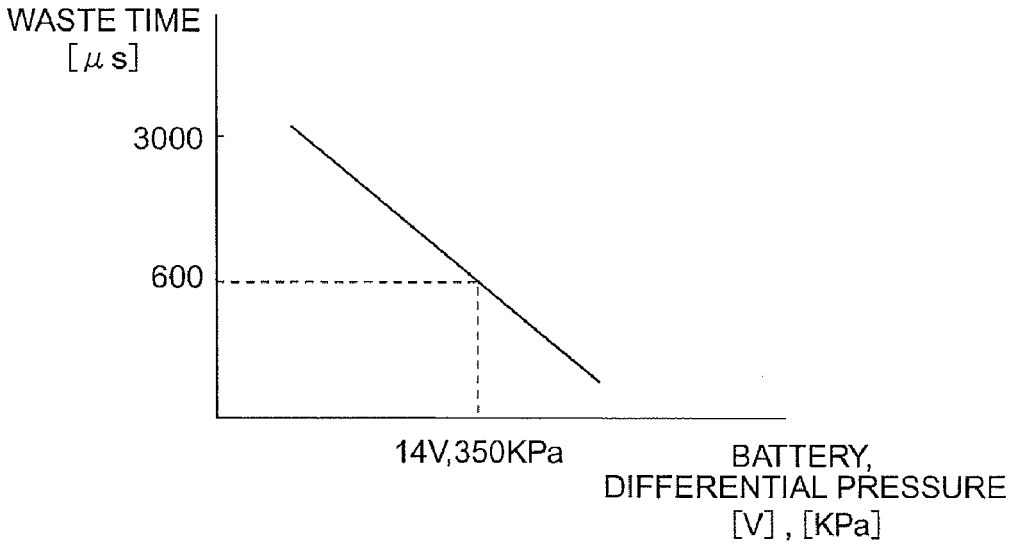
FIG. 12 is a graph for describing a characteristic of a waste time map stored in the storing means in the ECU.

FIGS. 11 and 12 are diagrams for describing a waste time calculating function by the waste time calculating function unit 406 illustrated in FIG. 3. FIG. 11 is a flowchart for setting waste time. FIG. 12 is a graph for describing a characteristic of a waste time map. In S1101, the waste time calculating function unit 406 sets, as the waste time, data set from intake manifold differential pressure calculated by the intake manifold differential pressure calculating function unit 402 and map data of the battery voltage 304. The waste time map having the characteristic as illustrated in FIG. 12 includes a three-dimensional map of the intake manifold differential pressure and battery voltage and the waste time and is stored in an area corresponding to the waste time calculating function unit of the ROM (not shown) in the microcomputer in the ECU. Note that, although the waste time map as illustrated in FIG. 12 includes the three-dimensional map of the intake manifold differential pressure and battery voltage and the waste time, the waste time may be calculated by using a two-dimensional map of the intake manifold differential pressure or the battery voltage and the waste time.

Injection Time Conversion Coefficient Calculating Function

Figure 13:
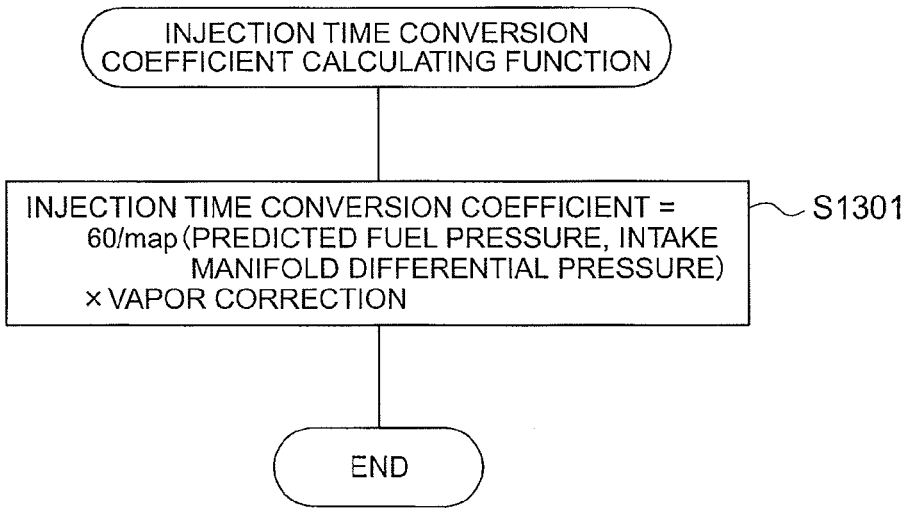
FIG. 13 is a flowchart for describing an injection time conversion coefficient calculating function by an injection time conversion coefficient calculating function unit 407 illustrated in FIG. 3.
Figure 14:
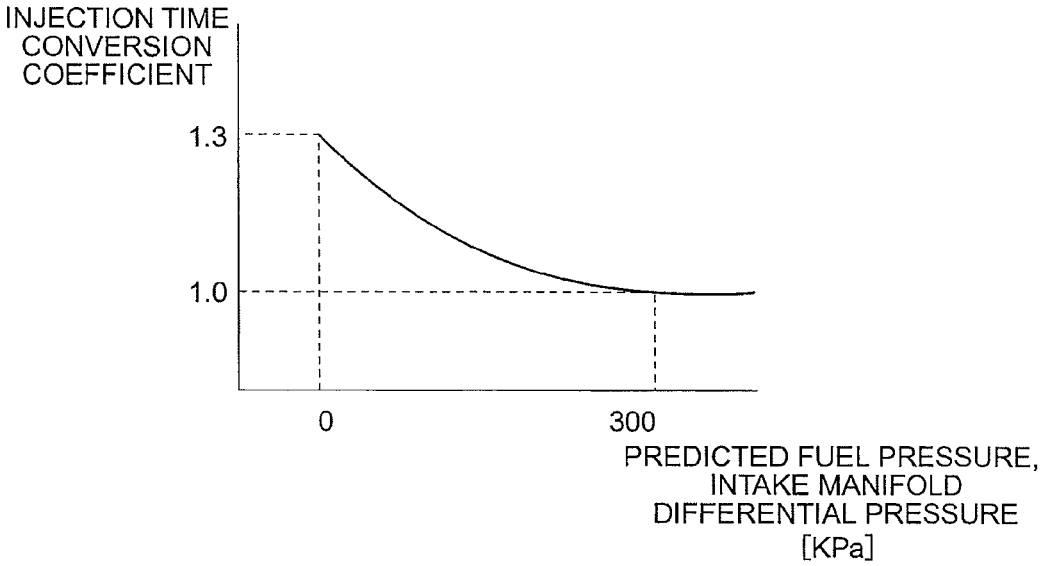
FIG. 14 is a graph for describing a characteristic of an injection time conversion coefficient map stored in the storing means in the ECU.

FIGS. 13 and 14 are diagrams for describing an injection time conversion coefficient calculating function by the injection time conversion coefficient calculating function unit 407 illustrated in FIG. 3. FIG. 13 is a flowchart for setting an injection time conversion coefficient. FIG. 14 is a graph for describing a characteristic of an injection time conversion coefficient map. The injection time conversion coefficient is a conversion coefficient in converting an injection amount into injection time. The conversion coefficient changes according to the following: predicted fuel pressure; predicted pressure calculated to make vapor correction effective for actual injection; and the vapor correction. In S1301, the injection time conversion coefficient calculating function unit 407 calculates, as the injection time conversion coefficient, a value obtained by dividing 60 by a value obtained by multiplying a value of an injection time conversion coefficient, which is calculated from the three-dimensional map of the predicted fuel pressure and intake manifold differential pressure and the injection time conversion coefficient, with a vapor correction amount. The three-dimensional map of the predicted fuel pressure and intake manifold differential pressure and the injection time conversion coefficient can be set by fixing data of the predicted fuel pressure and the intake manifold differential pressure or the injection time conversion coefficient even in the engine of manual start or having a battery. The three-dimensional map is stored in an area corresponding to the injection time conversion coefficient calculating function unit of the ROM (not shown) in the microcomputer in the ECU. Note that, although the injection time conversion coefficient map illustrated in FIG. 14 includes the three-dimensional map of the predicted fuel pressure and intake manifold differential pressure and the injection time conversion coefficient, the injection time conversion coefficient may be calculated by using a two-dimensional map of the predicted fuel pressure or the intake manifold differential pressure and the injection time conversion coefficient.

Injection Amount Calculating Function

Figure 15:
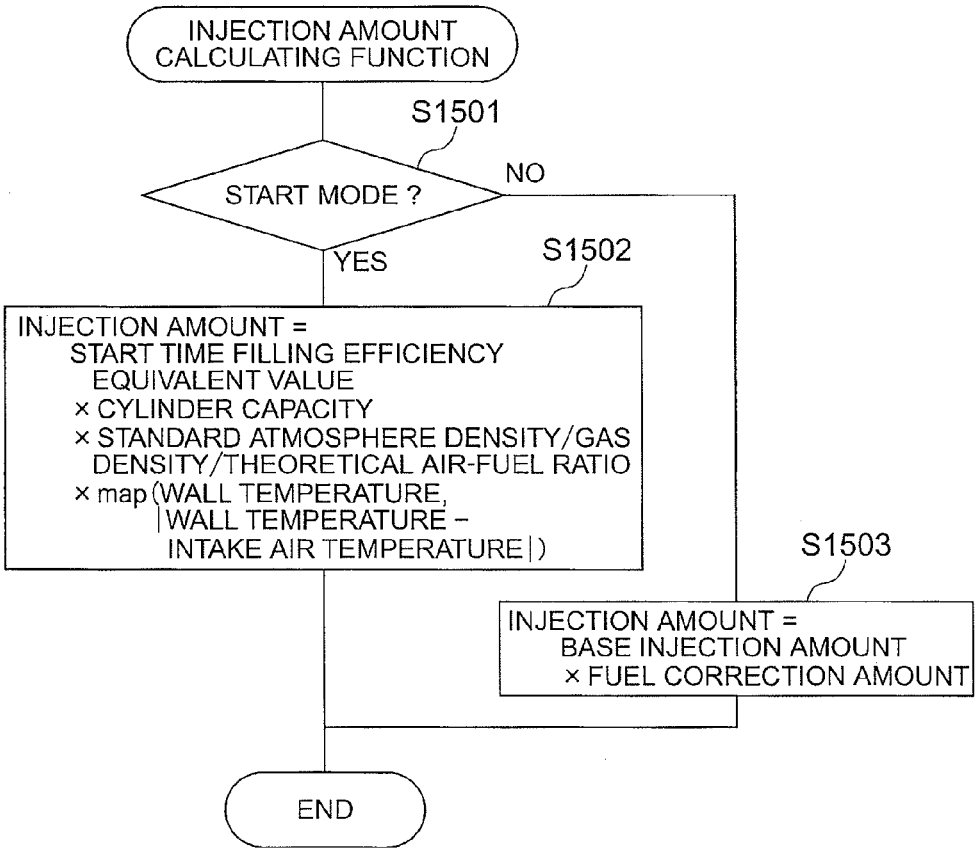
FIG. 15 is a flowchart for describing an injection amount calculating function by an injection amount calculating function unit 408 illustrated in FIG. 3.
Figure 16:
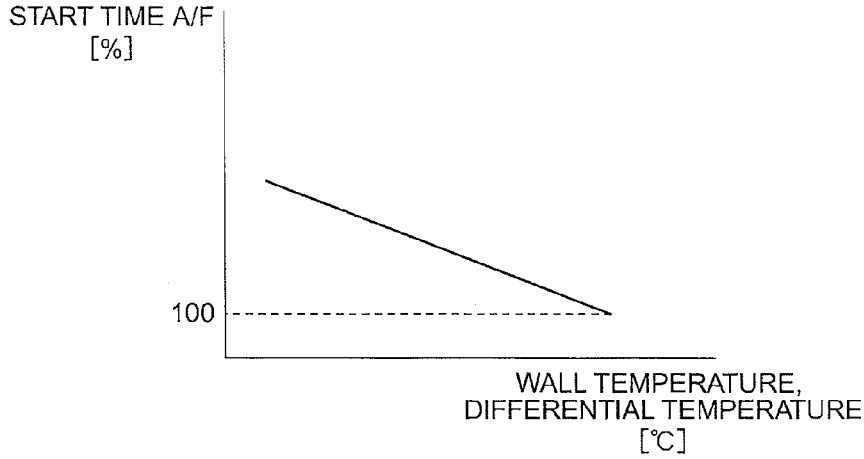
FIG. 16 is a graph for describing a characteristic of a start time air-fuel ratio map stored in the storing means of the ECU.

FIGS. 15 and 16 are diagrams for describing an injection amount calculating function by the injection amount calculating function unit 408 illustrated in FIG. 3. FIG. 15 is a flowchart for setting an injection amount. FIG. 16 is a graph for describing a characteristic of a start time air-fuel ratio map. In S1501, the injection amount calculating function unit 408 carries out determination of a start mode. When a determination result is true, the injection amount calculating function unit 408 calculates an injection amount for start. The injection amount calculating function unit 408 calculates, as the injection amount, a value obtained by multiplying set data of a filling efficiency equivalent value during the start with a cylinder capacity and the standard atmosphere density, dividing the multiplied value by gas density and a theoretical air-fuel ratio, and multiplying the divided value with a value of a start time air-fuel ratio extracted from a three-dimensional map data of the wall temperature and the differential temperature (absolute value of differential temperature between the wall temperature and the intake air temperature) and the start time air-fuel ratio (S1502). When the determination result in S1051 is false, the injection amount calculating function unit 408 calculates, as the injection amount, a value obtained by multiplying the base injection amount calculated by the base injection amount calculating function unit 401 with the fuel correction amount 303 (S1503). The three-dimensional map of the wall temperature and differential temperature and the start time air-fuel ratio is stored in an area corresponding to the injection amount calculating function unit of the ROM (not shown) in the microcomputer in the ECU. Note that, although the start time air-fuel ratio map illustrated in FIG. 16 includes the three-dimensional map of the wall temperature and differential temperature and the start time air-fuel ratio, the start time air-fuel ratio may be calculated by using a two-dimensional map of the wall temperature or the differential temperature and the start time air-fuel ratio.

Injector Driving Time Calculating Function

Figure 17:
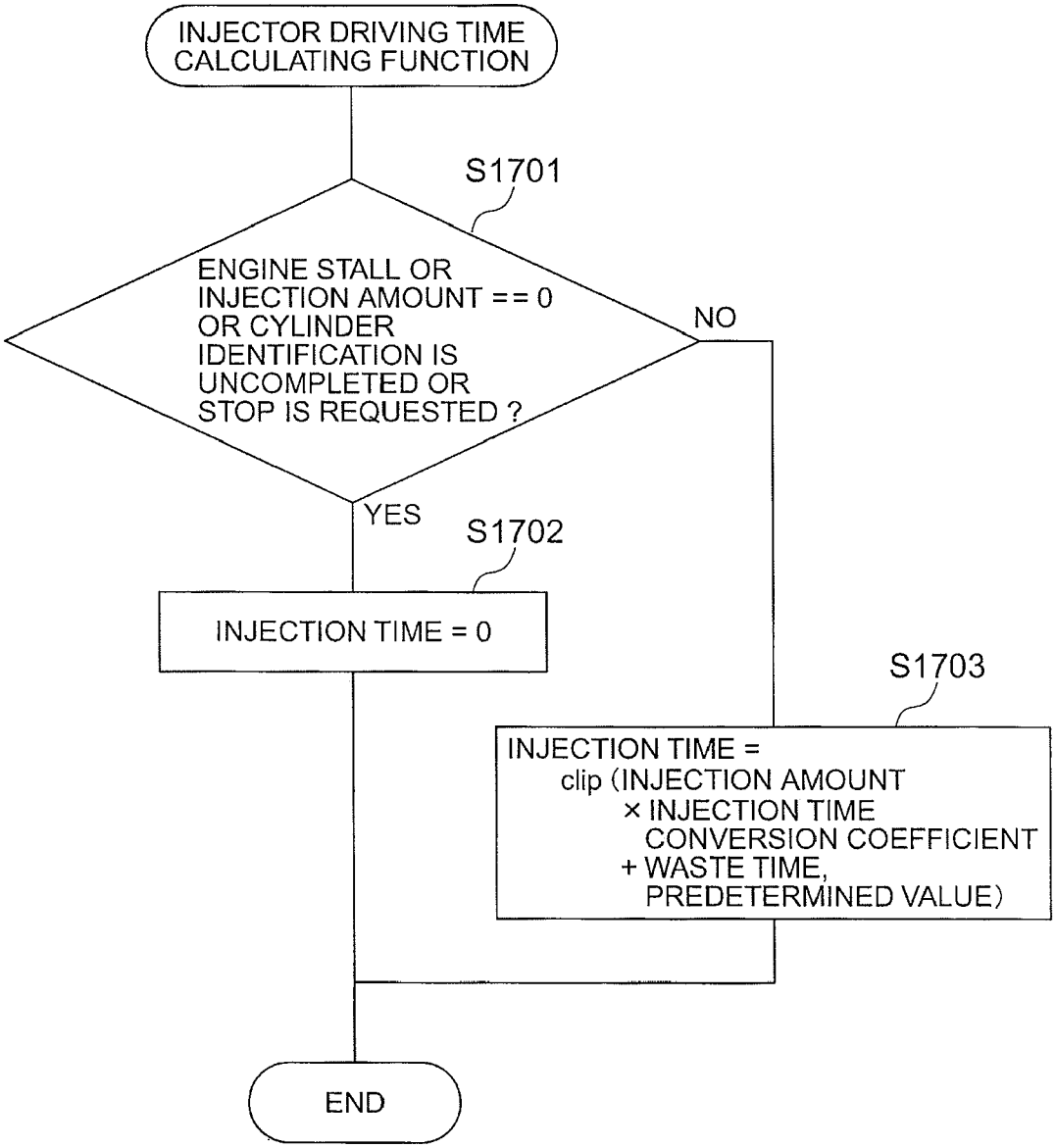
FIG. 17 is a flowchart for describing an injector driving time calculating function by an injector driving time calculating function unit 501 illustrated in FIG. 3.

FIG. 17 is a flowchart for describing an injector driving time calculating function by the injector driving time calculating function unit 501 illustrated in FIG. 3. In S1701, the injector driving time calculating function unit 501 determines whether an engine stall occurs, an injection amount is 0, cylinder identification is completed, and a driving stop request is received. When a determination result is true, in S1702, the injector driving time calculating function unit 501 sets injection time to 0 and performs actual injector driving at 0 ms (stops the injector driving). When the determination result in S1701 is false, the injector driving time calculating function unit 501 sets ejection time to be clipped not to be equal to or larger than a predetermined value by multiplying the injection amount calculated by the injection amount calculating function unit 408 with the injection time conversion coefficient calculated by the injection time conversion coefficient calculating function unit 407 and adding the waste time calculated by the waste time calculating function unit 406 (S1703).

Figure 18:
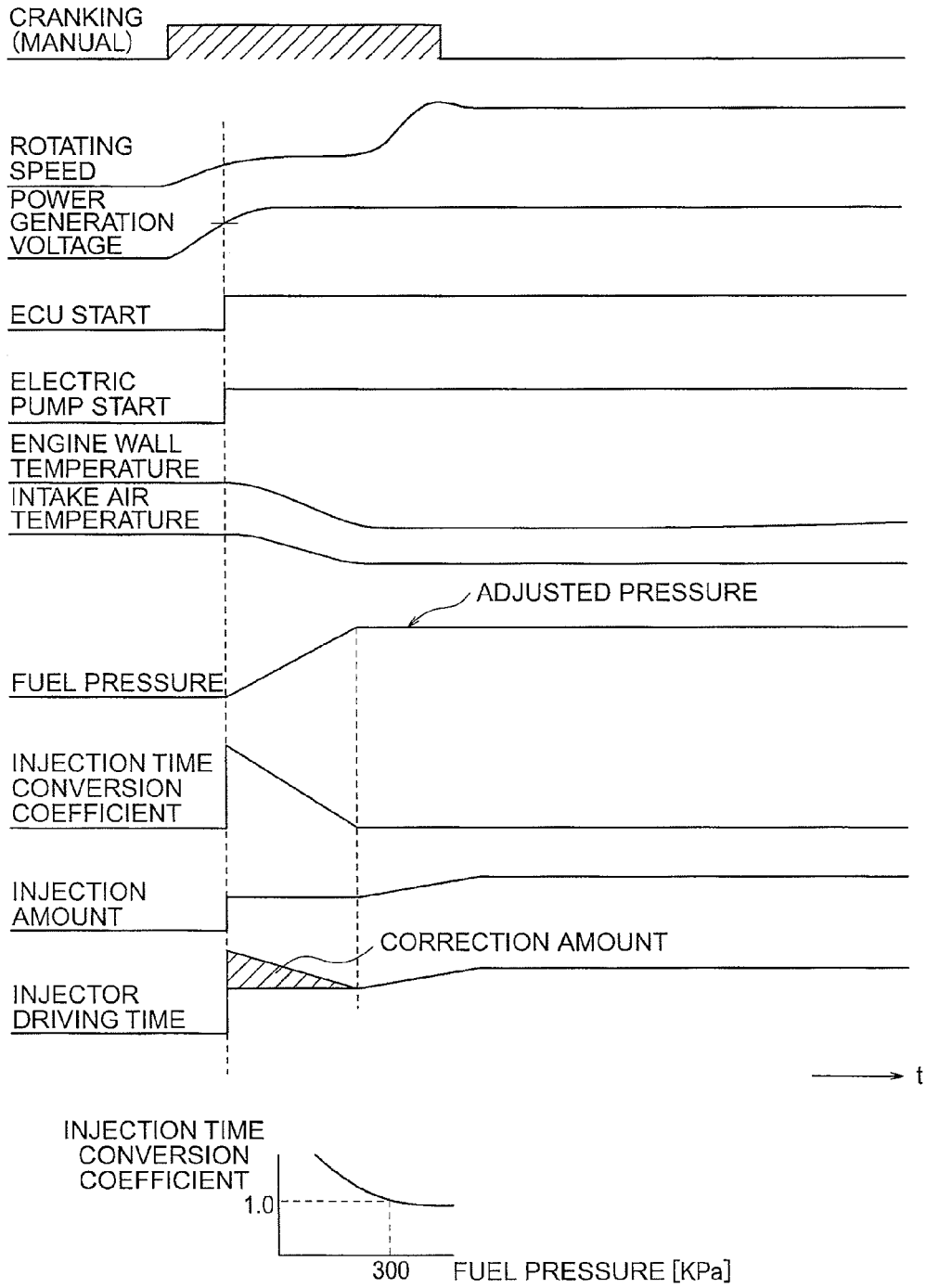
FIG. 18 is a timing chart for supplementing the description of the calculation of an injection amount conversion coefficient in the configuration illustrated in FIG. 3.

FIG. 18 is a timing chart for supplementing the description of the calculation of the injection amount conversion coefficient in the configuration illustrated in FIG. 3. When cranking is manually carried out and voltage is raised by the generator 44 to reach predetermined voltage, the ECU 30 and the electric fuel pump 41 are started. In this case, an initial value of the fuel pressure is calculated from a map table of the wall temperature and the intake air temperature. Predicted fuel pressure is calculated in synchronization with engine rotation. In a state in which the fuel pressure is low, a value of the injection time conversion coefficient is large and the injector driving time is long. The injection time conversion coefficient (for extending the injection time and increasing the injection amount because of the low fuel pressure) converges to a normal value as the fuel pressure rises. The injector driving time equivalent to the increase in the fuel pressure is gradually lowered to normal setting. When the fuel pressure increases to the adjusted pressure, fuel injection control is carried out only by normal fuel control.

Figure 19:
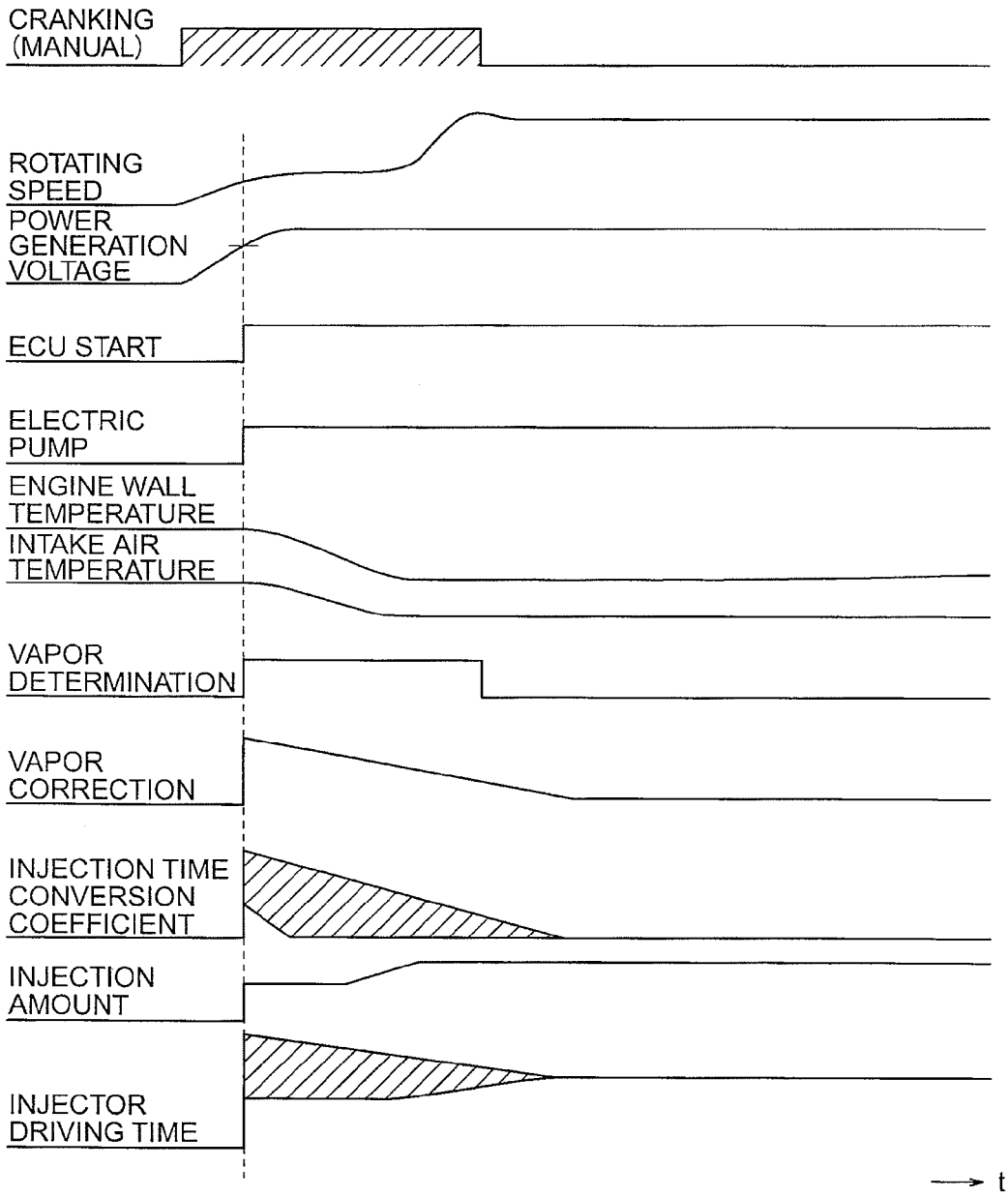
FIG. 19 is a timing chart for supplementing the description of the calculation of a vapor correction value in the configuration illustrated in FIG. 3.

FIG. 19 is a timing chart for supplementing the description of the calculation of the vapor correction value in the configuration illustrated in FIG. 3. When cranking is manually carried out and voltage is raised by the generator 44 to reach predetermined voltage, the ECU 30 and the electric fuel pump 41 are started. In this case, vapor determination is carried out by the ECU 30 in a state of the engine wall temperature and the intake air temperature. When it is determined that vapor occurs, a vapor correction amount is calculated from a map table of the engine wall temperature and the intake air temperature as an initial state. The vapor correction amount is gradually decreased in synchronization with engine rotation. As in FIG. 13, during the vapor correction, a value of the injection time conversion coefficient is changed and the injector driving time is set to be long with an amount of the vaporized fuel taken into account to supply a proper amount of fuel. When the vapor correction amount decreases to nil, the fuel injection control is carried out only by the normal fuel control.

Note that, in this embodiment, the fuel pump that supplies the fuel is not limited to the electric fuel pump. This embodiment is also effective when a fuel pump driven by a crank shaft of an engine is used.

As described above, according to the present invention, when the fuel pressure is insufficient and appropriate fuel injection cannot be performed during the manual start of the engine without a battery, it is possible to set the injection time to be longer than predetermined injection time and easily set adjustment of the injection time by setting the injection time conversion coefficient with adapted data. This makes it possible to perform smooth manual engine start with an appropriate amount of fuel. Even in the idling state, it is possible to maintain stable idling immediately after the start with the adapted data. Therefore, it is possible to realize improvement of startability in the manual start of the engine not mounted with a battery and provide a more accurate fuel injection control apparatus for an engine.

Irrespectively of presence or absence of a battery, it is possible to set the injection time to be longer than predetermined injection time and easily set adjustment of the injection time by setting the injection time conversion coefficient with adapted data even when appropriate fuel injection cannot be performed because of occurrence of vapor during engine start. This makes it possible to perform smooth engine start with an appropriate amount of fuel. Even in the idling state, it is possible to maintain stable idling immediately after the start with the adapted data. Therefore, it is possible to realize improvement of startability and provide a more accurate fuel injection control apparatus for an engine.

What is claimed is:

1. A fuel injection control apparatus for an engine, comprising:
- operation state detecting means for detecting an operation state of the engine;
- a fuel pump having a fuel pressure adjusting function;
- an injector that supplies fuel to the engine based on pressure of the fuel supplied by the fuel pump;
- power generating means for generating power based on rotation driving of a crank shaft of the engine;
- a starting device for manually starting the engine; and
- control means for starting with power generation voltage by the power generating means and calculating a fuel injection amount based on a detection value from the operation state detecting means, wherein
- the control means comprises:
  - an injection amount calculating function unit that calculates, according to the operation state of the engine, an injection amount of the fuel to be supplied to the engine;
  - an injection time conversion coefficient calculating function unit that calculates an injection time conversion coefficient for converting the injection amount into injector driving time based on a predicted fuel pressure value; and
  - an injector driving time calculating function unit that calculates driving time of the injector based on an output of the injection amount calculating function unit and an output of the injection time conversion coefficient calculating function unit.

2. The fuel injection control apparatus for an engine according to claim 1, wherein the injection time conversion coefficient calculating function unit calculates the injection time conversion coefficient by using map data present in storing means in an ECU in every predetermined period of time after the start of the control means or each predetermined engine number of revolutions.

3. The fuel injection control apparatus for an engine according to claim 1, wherein:

the control means further comprises:

a predicted fuel pressure calculating function unit that predicts and calculates fuel pressure of the fuel to be supplied to the injector from map data comprising at least one of engine temperature and intake air temperature during the start of the control means; and an intake manifold differential pressure calculating function unit that calculates intake manifold differential pressure from average intake air pressure and atmospheric pressure; and the injection time conversion coefficient calculating function unit calculates the injection time conversion coefficient based on a predicted fuel pressure value from the predicted fuel pressure calculating function unit and the intake manifold differential pressure from the intake manifold differential pressure calculating function unit.

4. The fuel injection control apparatus for an engine according to claim 3, wherein:

the control means further comprises a waste time calculating function unit that calculates waste time from battery voltage and the intake manifold differential pressure from the intake manifold differential pressure calculating function unit; and the injector driving time calculating function unit calculates injector driving time by clipping a value obtained by adding the waste time calculated by the waste time calculating function unit to a value obtained by multiplying the injection amount calculated by the injection amount calculating function unit with the injection time conversion coefficient calculated by the injection time conversion coefficient calculating function unit so that the value is not equal to or larger than a predetermined value.

5. The fuel injection control apparatus for an engine according to claim 1, wherein:

the control means further comprises:

a vapor determining unit that determines, based on engine temperature and intake air temperature during the start of the control means, presence or absence of vapor that occurs in a fuel pipe between the injector and the fuel pump; and a vapor correction amount calculating function unit, which calculates, when it is determined by the vapor determining unit that vapor occurs, a vapor correction amount from map data comprising at least one of the engine temperature and the intake air temperature during the start of the control means, and gradually reduces a set value of the vapor correction amount from an initial value in every predetermined period of time after the engine start or each predetermined number of revolutions of the engine until the vapor correction amount decreases to zero; and the injection time conversion coefficient calculating function unit calculates a new injection time conversion coefficient from the calculated injection time conversion coefficient taking into account the vapor correction amount from the vapor correction amount calculating function unit.

6. The fuel injection control apparatus for an engine according to claim 1, wherein:

the control means further comprises a base injection amount calculating function unit that calculates a base injection amount based on a filling efficiency equivalent value during the start; and the injection amount calculating function unit multiplies the filling efficiency equivalent value with a cylinder capacity and standard atmosphere density, divides the multiplied value by gas density and theoretical air-fuel ratio, and multiplies the divided value with a value extracted from map data of engine temperature and an absolute value of differential temperature between the engine temperature and the intake air temperature, and calculates the multiplied value as an injection value.

* * * * *